United States Patent [19]

Fontaine

[11] 4,263,575

[45] Apr. 21, 1981

[54] FUSE CARTRIDGES

[75] Inventor: Jean-Claude Fontaine, Ecully, France

[73] Assignee: Lucien Ferraz & Cie., Lyons, France

[21] Appl. No.: 54,529

[22] Filed: Jul. 3, 1979

[30] Foreign Application Priority Data

Jul. 6, 1978 [FR] France ..... 78 21324

[51] Int. Cl.[3] ..... H01H 85/30

[52] U.S. Cl. ..... 337/241; 337/244

[58] Field of Search ..... 339/252 F, 253 F, 256 C, 339/258 F, 259 F, 262 F; 337/241, 244, 265, 267, 206, 213

[56] References Cited

U.S. PATENT DOCUMENTS

| | | | |
|---|---|---|---|
| 3,535,668 | 10/1970 | Cinquin | 337/244 |
| 3,601,739 | 8/1971 | Blewitt | 337/244 |

FOREIGN PATENT DOCUMENTS

| | | | |
|---|---|---|---|
| 708377 | 6/1941 | Fed. Rep. of Germany | 337/244 |
| 1194961 | 6/1965 | Fed. Rep. of Germany | 337/241 |
| 61490 | 8/1931 | Netherlands | 337/244 |

*Primary Examiner*—George Harris

*Attorney, Agent, or Firm*—Dowell & Dowell

[57] ABSTRACT

In a fuse cartridge the indicator button, normally retained within a head of the cartridge and adapted to protrude outwardly when the latter has "blown", is disposed axially to the said head and the contact blade corresponding to the latter has a notch formed in its inner transverse edge (the edge connected to the head) in order to define a space which may receive the indicator button. Moreover the lateral sides of the blade have laterally projecting ribs to limit the portion of said blade which may be inserted into the clamp of a cartridge support, thus preventing such a clamp from hindering the protruding movement of the indicator button.

1 Claim, 2 Drawing Figures

FUSE CARTRIDGES

The present invention relates to fuse cartridges of the kind comprising a tubular insulating body having a metallic head at each end, these heads being electrically connected with each other by means of fusible wires or elements disposed within the insulating body. The latter is generally filled with an appropriate arc-quenching substance, such as silica sand, in which the fusible elements are embedded.

The heads are more than often provided with axially extending blades adapted to form flat contacts which may be easily inserted into the resilient metallic clamps of an appropriate support. Furthermore in order to facilitate the detection of the cartridge which has "blown" among a group of such cartridges, as for instance on an electric panel or switchboard, it is conventional to provide an indicating spring-loaded button which is normally retained within the body by a main or auxiliary fusible element and which protrudes outwardly when this element has been destroyed.

The indicator button may be disposed in a transverse depression of the tubular body of the cartridge. This has the advantage that the button may easily actuate an alarm micro-switch, but such an arrangement complicates the construction and requires that in the absence of such a switch the cartridge be properly disposed on its support, since if the button is directed towards the support, it is not easily apparent for an operator. It is therefore more convenient to mount such a button in a longitudinal bore provided in one of the heads. But in the case of a cartridge having axially extending blades adapted to be inserted into resilient clamps of a cartridge support, this arrangement has the disadvantage that the button must be disposed at a radial distance from the cartridge axis and that if the clamp corresponding to the head in which it is mounted is too close to the said head, this clamp acts as an external abutment which retains the button within the head even when the cartridge has blown.

It is an object of the present invention to avoid these drawbacks and to provide a fuse cartridge wherein the indicator button will be able to shift axially in spite of the presence of a contact blade, without any risk of being rendered ineffective by the clamp into which the said blade may be inserted.

In accordance with the present invention the blade asociated with the head in which the indicator button is provided, has a notch centrally formed in its transverse and where it joins said head to define an axial space into which the indicator button may protrude, and it is provided with laterally protruding transverse ribs spaced from the said head in such manner that the notched portion of the length of the blade comprised between the said head and the ribs cannot be inserted into the clamp of a conventional support.

Figure 1:
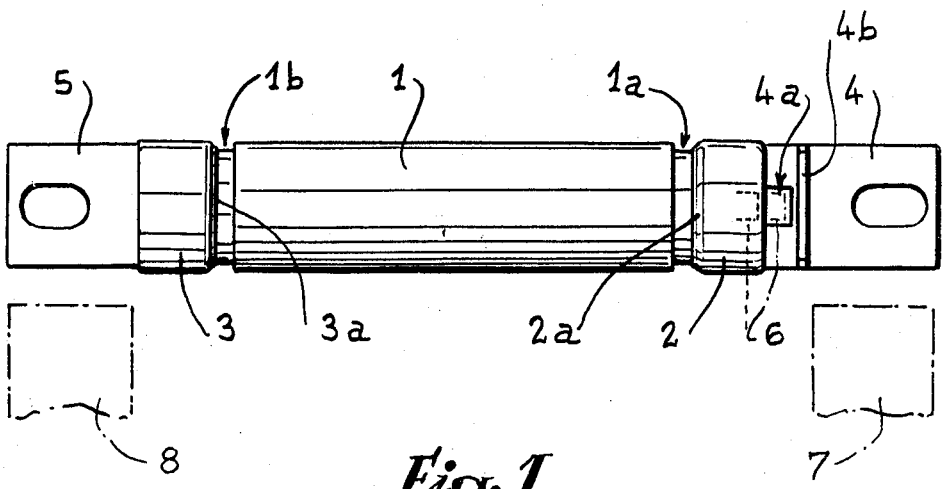
FIG. 1 is a side view of the fuse cartridge according to the invention.

The cartridge generally illustrated in FIG. 1 comprises a tubular insulating body 1, preferably made of a ceramic material, the ends of which are closed by metallic heads or caps 2, 3 made of copper or the like and appropriately retained in position. In the embodiment illustrated heads 2 and 3 have their edges 2*a*, 3*a* crimped in circular groves 1*a*, 1*b* formed on the periphery of body 1 close to the ends thereof. Each head 2, 3 is unitary with a longitudinally extending flat faced blade 4, respectively 5, in the conventional manner. Blades 4 and 5 are apertured in such manner that they may be fixed on a support by means of screws or the like, but they are more generally intended to be inserted into resilient clamps.

Heads 2 and 3 are electrically connected with each other by means of a number of fusible wires disposed within the tubular body 1, preferably in a mass of sand or like arc-quenching substance in the quite conventional manner.

Blade 4 has a notch 4*a* centrally formed in its edge or base in contact with head 2, this notch defining a void space or aperture and immediately after this notch or aperture blade 4 has on each of its flat sides a laterally protruding transverse rib 4*b*.

The cartridge is further equipped with an indicator button 6 disposed in an axisl bore of head 2. Button 6 is urged outwardly by an appropriate spring, but it is retained at a non-protruding position by an axial fusible element of the cartridge. Since apart from the particular arrangement of blade 4 with its central notch 4*a* and its transverse ribs 4*b*, such as indicator device is quite common in the art, the loading spring and the retaining fusible wire associated to button 6 have not been illustrated in the drawing.

Figure 2:
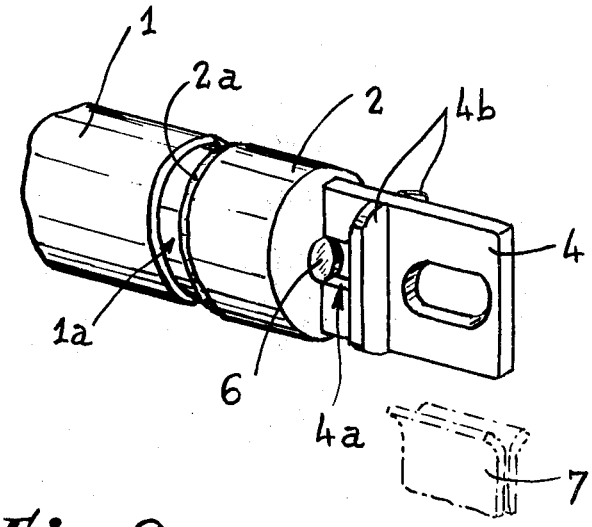
FIG. 2 is a fragmental perspective view showing the end of the cartridge wherein the indicator button is provided.

It will be noted in FIG. 2 that the indicator button 6 is cylindrical and that its diameter is lower than the width of the notch 4*a* formed in the adjacent blade 4.

The fuse cartridge described may easily be mounted on a conventional support having resilient clamps as indicated in dash and dot lines at 7 and 8 in the drawing. Considering FIG. 1, it is obvious that when the cartridge is pushed downwardly in order that its blades 4 and 5 enter the blade receiving slots in the clamps 7 and 8, it is quite impossible for a careless operator to position the cartridge in such manner that clamp 7 covers notch 4*a*, which would render indicator button 6 quite ineffective, this being prevented by ribs 4*b* which stand out from the faces of the blades and would bear on the upper edge of the clamp if for instance the cartridge were too much to the right in FIG. 1. Notch 4*a* is thus always fully exposed and if the cartridge blows, button 6 becomes immediately quite apparent.

The heads of the fuse cartridge could be of any type and their fixation to the ends of the insulating body could be realized in any manner, as for instance by means of screws. The lateral ribs 4*b* could be replaced by any appropriate kind of lateral projections adapted to bear against the clamp 7 if the cartridge is not properly disposed relatively to the latter. It is further to be remarked that the lateral ribs or projections could be of interest even if the indicator button were provided on head 2 at a distance from the cartridge axis, since they would still prevent an incorrect mounting of the cartridge on its support with the clamp such as 7 hindering the outward displacement of the button.

What I claim is:

1. In a fuse cartridge having a tubular insulating body with a central axis, the ends of the body being closed by metallic heads respectively carrying flat faced contact blades extending axially from the heads in opposite directions and disposed to support the cartridge in spaced clamps having aligned blade-receiving slots, and the cartridge having an axially disposed bore in one head containing an indicator button operative to protrude axially from the head when the fuse is blown, the improvements wherein the contact blade which extends from said one head has a closed-end notch extending from the bore and aligned therewith and terminating partway along the blade to provide a longitudinal clearance for the indicator button when protruding from the head; and wherein the notched blade has a transverse rib located adjacent to the closed end of the notch and extending transversely across the blade and standing out from at least one face of the blade to a height greater than the thickness of the blade.

* * * * *